United States Patent [19]

Keppeler

[11] 3,945,142

[45] Mar. 23, 1976

[54] MOUNT FOR A SIGHT ON FIREARMS

[75] Inventor: Dieter Keppeler, Ulm (Danube), Germany

[73] Assignee: Carl Walther, Sportwaffenfabrik, Ulm (Danube), Germany

[22] Filed: Aug. 2, 1974

[21] Appl. No.: 494,069

[52] U.S. Cl. ..... 42/1 S; 33/233

[51] Int. Cl.[2] ..... F41G 11/00

[58] Field of Search ..... 42/1 S; 33/233

[56] References Cited

UNITED STATES PATENTS

| | | | |
|---|---|---|---|
| 2,030,312 | 2/1936 | Mossberg | 42/1 S |
| 2,039,907 | 5/1936 | Jefferson | 42/1 S |
| 2,380,965 | 8/1945 | Harvey | 42/1 S |
| 3,292,264 | 12/1966 | Kincannon | 42/1 S |

*Primary Examiner*—Charles T. Jordan

*Attorney, Agent, or Firm*—Edmund M. Jaskiewicz

[57] ABSTRACT

A front or rear sight is mounted on a barrel of a firearm by an open ring positioned around the barrel and having spaced ends upon which is mounted a fastening element. A nut is retained on the upper surface of the fastening element and a mount for a sight is positioned over the nut and fastening element. A screw passes through the mount to be threaded into the nut so that tightening of the screw will draw the fastening element and nut upwardly to tighten the ring around the barrel.

6 Claims, 3 Drawing Figures

MOUNT FOR A SIGHT ON FIREARMS

The present invention relates to the mounting of a sight on a firearm, more particularly, to attaching and securing the front and rear sight on the barrel of the firearm after processing of the barrel has been completed.

Various forms of gun sights including both front and rear sights have been mounted in many different ways on the barrels of hand firearms and air guns. A common and well-known arrangement comprises mounting of the sight on the barrel with the use of soft-solder. This arrangement has several disadvantages in that a relatively high degree of skill is required on the part of the personnel mounting the sights and further the soldering process is relatively expensive. In addition, to carry out such a soldering operation requires considerable time with respect to other manufacturing operations. Another disadvantage is that soft-soldered firearm components cannot be treated for rust-proofing in a antirust bath since the solder generally decomposes therein. As a result, it is necessary to again apply a time-consuming and expensive operation in order to rust-proof the firearm after the sights have been mounted with soft-solder.

Another arrangement for mounting a sight consists in tapping a blind hole in the barrel and attaching the sight to the barrel by a suitable screw. This has the disadvantage that the wall of the barrel must be relatively thick. Another disadvantage is that it is not possible to undertake a subsequent adjustment of the barrel in order to regulate the breech distance if one desires to avoid any likelihood of inadvertently laterally moving the sight so as to cause its misalignment.

It is also known to attach the components of the sight by means of a ring pressed on the barrel. This arrangement is disadvantageous since the manufacturing operation to obtain a satisfactory press fit and the fabrication of the components with the rings to be pressed onto the barrel are relatively expensive. In addition, soldering, bolts or screws are frequently additionally required in order to secure the sight components in a more reliable manner.

It is therefore the principal object of the present invention to provide a novel and improved arrangement for the mounting of a sight on a barrel of a firearm.

It is another object of the present invention to provide for the mounting of a sight on the barrel of a firearm by means of an economical manufacturing operation and which results in a clean and neat appearance of the assembled sight on the firearm.

It is a further object of the present invention to provide an arrangement for mounting of a sight which does not require any drilling or tapping of the barrel and which can be subjected to a rust-proofing process without adversely affecting the mount.

According to one aspect of the present invention a front or rear sight may be mounted on the barrel of a firearm by means of an open ring having spaced ends and positioned around the barrel. A fastening element is mounted on the spaced ends of the ring and a nut is retained on the upper surface of the fastening element. A mount for a sight is positioned over the nut and fastening element and a screw is passed through the mount to be threaded into the nut so that tightening of the screw will draw the fastening element and nut upwardly to tighten the ring and therefore the mount on the barrel.

Other objects and advantages of the present invention will become apparent upon reference to the accompanying description when taken in conjunction with the following drawings, which are exemplary, wherein.

Proceeding next to the drawings wherein like reference symbols indicate the same parts throughout the various views, a specific embodiment of the present invention will be described in detail.

Figure 1:
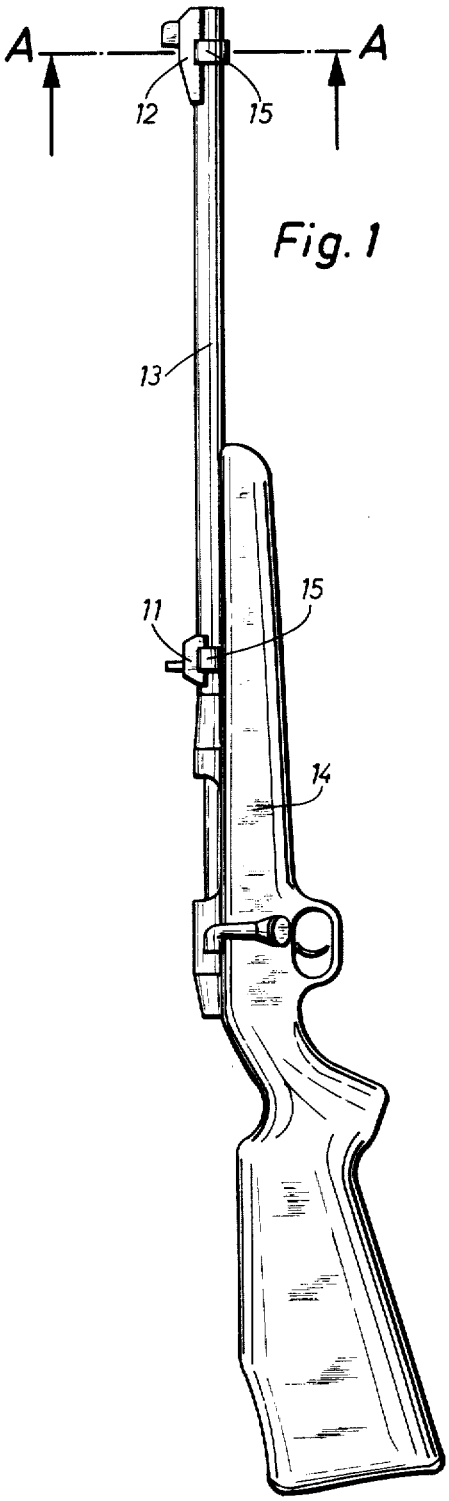
FIG. 1 is a side elevational view of a firearm upon which a sight is mounted in accordance with the present invention.

As may be seen in FIG. 1, the sighting system comprises a rear sight 11 and a front sight attachment 12 both mounted in the simple and effective manner according to the present invention on a barrel 13 of a firearm which may be a rifle or an air gun 14. Since both the front and rear sight can be mounted in the same manner the description will describe in detail the mounting only for the front sight 12.

Figure 2:
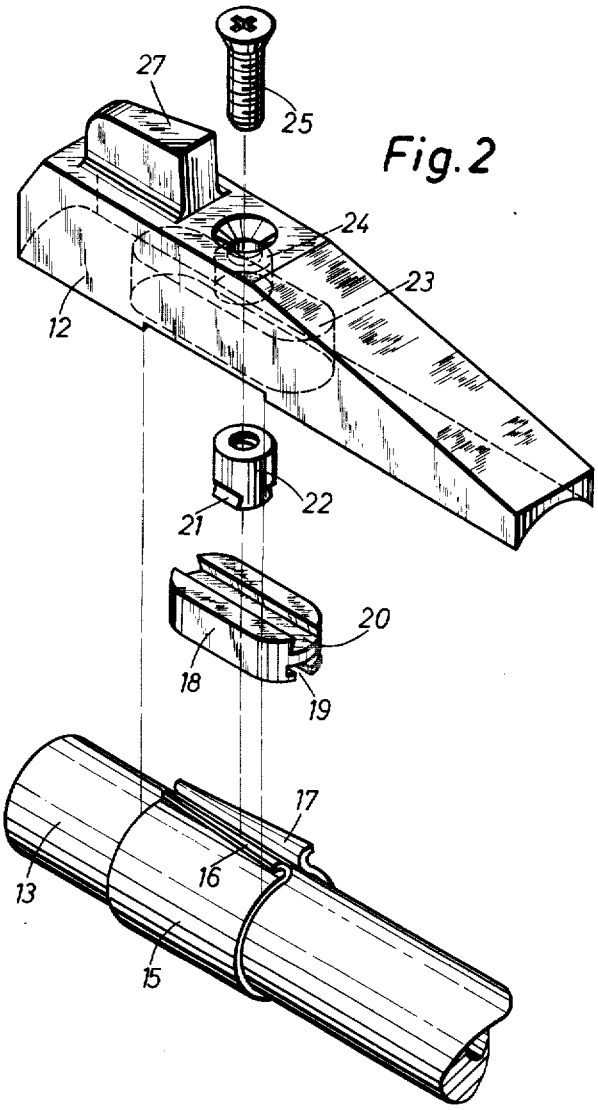
FIG. 2 is an exploded view in perspective of the several components of the arrangement for mounting the sight.
Figure 3:
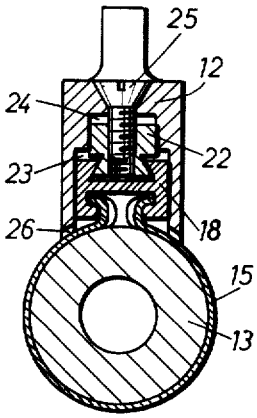
FIG. 3 is a sectional view taken along the line A—A of FIG. 1.

As may be seen in FIG. 2, the mounting arrangement for the sight 12 comprises an open ring 15 made of sheet metal which is slid over the front portion of the barrel 13. The ring 15 has spaced ends 16,17 which are bent upwardly and then outwardly so that the upper portions thereof have a wedge shape. The ends 16,17 when viewed from the end have a dove-tail or T-shaped configuration. A fastening element 18 is provided on its underside with longitudinal extending guide surfaces 19 which are shaped to receive the ring ends 16,17. When the fastening element 18 is slid upon the ring end 16,17 by means of its T-shape slot 19 the ring is actually securely fastened at this stage upon the weapon. This fastening effect is achieved by the wedge-shape of the ends 16,17 which are cammed or wedged into the horizontally extending portion of the T-slot 19.

A further advantage of this arrangement is that a secure fit between the fastening element 18 and the band 15 can be obtained without the necessity of the precise and fine tolerances which would be required with rings which are pressed onto the barrel according to the prior art as described above.

On the upper surface of fastening element 18 there is provided an additional parallel guide groove 20 in which the side walls are inclined inwardly to receive a correspondingly shaped guide portion 21 on a threaded nut 22. The nut 22 is thus slidably adjustable upon the fastening element 18 in a direction parallel to the axis of the barrel 13.

The front sight attachment of mount 12 which is to be positioned upon the barrel is provided with recessed portions 23 and 24 in its underside so as to accommodate the nut 22 and the fastening element 18 therein. When the mount 12 is positioned upon the barrel 13 the fastening element 18 and nut 22 are thus completely covered and enclosed by the mount 12.

A screw 25 is then passed through the mount 12 on its upper surface and is threaded into the nut 22. Tightening of the screw 25 will thus hold the nut 22 and fastening element 18 upwardly which in turn will tighten the ring 15 around the barrel 13.

The underside of the mount 12 is curved as can be seen in FIG. 2 so as to comform to the peripheral surface of the barrel 13. In addition, the mount is provided with a notched portion 26 on its underside which closely receives the ring 15 to fix the mount against movement in the axial direction. The result is a secure and reliable fit of the front end sight mount 12 and therefore of the front sight 27 on the barrel.

While the present invention has been described in connection with a firearm having a relatively long barrel, such as a rifle, it is to be understood that this mounting of a sight can also be utilized with shorter barrel weapons such as various forms of hand guns and pistols.

A feature of the present invention is that the sight mounting arrangement as disclosed herein can be positioned and adjusted on the completed and treated firearm without any additional operations thereto and also, the sight can be readily removed from the firearm without any complicated operations. Thus, the rifle can be subjected to any desired rust-proofing or other processing or treating operations and upon the completion of these operations the sights can be securely mounted in position.

It will be understood that this invention is susceptible to modification in order to adapt it to different usages and conditions, and accordingly, it is desired to comprehend such modifications within the invention as may fall within the scope of the appended claims.

What is claimed is:

1. In a mounting of a sight on a barrel of a firearm, the combination of an open ring having spaced ends and positioned around the barrel, a fastening element mounted on said ring spaced ends, a nut retained on said fastening element, a mount for a sight positioned over said nut and fastening element, and a screw passing through said mount and threaded into said nut so that tightening of the screw will draw said fastening element and nut upwardly to tighten said ring around the barrel.

2. In a mounting as claimed in claim 1 and guide means on said fastening element parallel to the axis of the barrel for retaining said nut.

3. In a mounting as claimed in claim 1 wherein said spaced ends are bent upwardly and outwardly and the outwardly bent portions have a wedge shape, there being a wedged-shaped T-slot in the lower surface of said fastening element receiving said wedge-shaped ends of said ring.

4. In a mounting as claimed in claim 2 wherein said guide means are on the upper surface of said fastening element and comprise a slot having inwardly inclined side walls, said nut being provided with correspondingly shaped guide surfaces to be slidingly received within said fastening element slot so that the position of said nut is adjustable in a direction parallel to the barrel.

5. In a mounting as claimed in claim 1 wherein said mount has a recess in the underside thereof to accommodate said nut and fastening element.

6. In a mounting as claimed in claim 1 wherein there is a notch in said mount within which said ring is seated such that said mount rests firmly upon said barrel.

* * * * *